US011351090B2

(12) United States Patent
Brandenburger et al.

(10) Patent No.: US 11,351,090 B2
(45) Date of Patent: Jun. 7, 2022

(54) SEALING CAP FOR A CONTAINER FOR HOLDING A MEDICAL LIQUID

(71) Applicant: Fresenius Kabi Deutschland GmbH, Bad Homburg (DE)

(72) Inventors: Torsten Brandenburger, Reichelsheim (DE); Stefan Schwerer, Florstadt (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 1095 days.

(21) Appl. No.: 15/551,414

(22) PCT Filed: Mar. 24, 2016

(86) PCT No.: PCT/EP2016/056633
§ 371 (c)(1),
(2) Date: Aug. 16, 2017

(87) PCT Pub. No.: WO2016/156242
PCT Pub. Date: Oct. 6, 2016

(65) Prior Publication Data

US 2018/0055734 A1 Mar. 1, 2018

(30) Foreign Application Priority Data

Mar. 27, 2015 (EP) ..... 15161249

(51) Int. Cl.
*A61J 1/20* (2006.01)
*A61J 1/14* (2006.01)
*B65D 51/00* (2006.01)

(52) U.S. Cl.
CPC ..... *A61J 1/2048* (2015.05); *A61J 1/1406* (2013.01); *A61J 1/1431* (2015.05); *B65D 51/002* (2013.01)

(58) Field of Classification Search
CPC ..... A61J 1/2048; A61J 1/1431; A61J 1/1406; A61J 1/2055; A61J 1/2058; A61J 1/2062; B65D 1/002
See application file for complete search history.

(56) References Cited

U.S. PATENT DOCUMENTS 5,957,898 A * 9/1999 Jepson ..... A61M 39/045 128/912
2004/0141886 A1 7/2004 Py et al.
(Continued)

FOREIGN PATENT DOCUMENTS

CN 101061987 A 10/2007
CN 101600411 A 12/2009
(Continued)

*Primary Examiner* — Philip R Wiest
(74) *Attorney, Agent, or Firm* — Occhiuti & Rohlicek LLP

(57) ABSTRACT

A sealing cap for a container for holding a medical liquid comprising a cap body, which bounds an interior and has at least one opening, and at least one connection device, which is arranged on the cap body and to which a conveying device for feeding a medical liquid into the container or for removing a medical liquid from the container can be connected. The connection device has a sealing element, arranged on the cap body. The connection device has a break-off piece, which, in an initial state, is firmly connected to the cap body and covers the outer face of the sealing element in the outward direction. The break-off piece is connected to the cap body by means of a pre-determined breaking point. In addition, the sealing element is convex on the outer face.

16 Claims, 6 Drawing Sheets

(56) References Cited

U.S. PATENT DOCUMENTS

| | | | | |
|---|---|---|---|---|
| 2008/0011707 | A1* | 1/2008 | Suzuki | A61J 1/1406<br>215/296 |
| 2010/0059474 | A1* | 3/2010 | Brandenburger | A61J 1/1412<br>215/316 |

FOREIGN PATENT DOCUMENTS

| | | | | |
|---|---|---|---|---|
| DE | 102004051300 | | 11/2005 | |
| DE | 102004051300 | B3 | 11/2005 | |
| DE | 102008060864 | | 6/2010 | |
| DE | 102008060864 | A1 | 6/2010 | |
| DE | 102012021525 | | 4/2014 | |
| DE | 102012021525 | A1 | 4/2014 | |
| EP | 1010635 | A2 * | 6/2000 | A61J 1/1406 |
| FR | 2230560 | | 12/1974 | |
| FR | 2230560 | A1 | 12/1974 | |
| WO | 2006/042579 | | 4/2006 | |
| WO | 2007/120719 | | 10/2007 | |
| WO | 2007120719 | A2 | 10/2007 | |
| WO | 2008095665 | A1 | 8/2008 | |
| WO | 2010/066373 | | 6/2010 | |

* cited by examiner

SEALING CAP FOR A CONTAINER FOR HOLDING A MEDICAL LIQUID

CROSS REFERENCE TO RELATED APPLICATIONS

This application is a U.S. national stage application of International Application No. PCT/EP2016/056633, filed Mar. 24, 2016, which claims the benefit of the filing date of European Application No. 15161249.6, filed Mar. 27, 2015, the contents of which are hereby incorporated by reference in their entirety.

DESCRIPTION

The invention relates to a sealing cap for a container for holding a medical liquid according to the preamble of claim 1.

A sealing cap of this type includes a cap body which defines an interior and comprises at least one opening. At least one connecting device, to which a conveying device for supplying a medical liquid into the container or for removing a medical liquid out of the container can be connected, is arranged on the cap body. The connecting device comprises a sealing element which is arranged on the cap body and is arranged on the opening for sealing closure. A conveying device can be positioned on an outside surface of the sealing element which is remote from the interior for connecting the conveying device.

Such a conveying device can be designed, for example, as an injection syringe which can be positioned with an injection cannula against the sealing element and inserted into the sealing element in a positioning direction such that the sealing element is pierced by the injection cannula. Such an injection syringe is used, in particular, for supplying a medical liquid into the container. To remove a medical liquid out of the container, it is possible, in contrast, to use an infusion set, for example, which is positioned with a mandrel, which is also designated as a spike, against the sealing element such that the sealing element is pierced by the mandrel and consequently access to the container is created.

In the case of a sealing cap disclosed in WO 2006/042579 A1, two connecting devices are provided in each case with one sealing element. One of said connecting devices serves for supplying a medical liquid into a container which is connected to the sealing cap, for example a bottle, whilst the other connecting device serves for removing a medical liquid out of the container.

In the case of another sealing cap which is disclosed in WO 2010/066373 A1, three connecting devices are provided, a first of which serves for supplying a medical liquid by means of an injection syringe, a second for removing a medical liquid by means of an infusion set which comprises a mandrel and a third for providing a so-called needle-free access. The sealing element of the third connecting device comprises a slot opening which makes it possible for a conveying device, for example a syringe, to be positioned on the sealing element with a—needle-free—connecting part in order to open the sealing element and supply a liquid to the container in this way.

Legal requirements can make it necessary to wipe or dab the sealing element on its outside surface for disinfecting purposes prior to positioning a conveying device, for example an injection syringe for supplying a medical liquid or an infusion set for removing a medical liquid.

It is the object of the present invention to provide a sealing cap where the disinfecting of a sealing element arranged thereon is made simpler.

Said object is achieved by the subject matter with the features of claim 1. The sealing cap according to the invention closes an access to a container. For example, the sealing cap closes the opening in the bottle neck of a bottle.

The sealing element is accordingly realized in a convex manner on its outside surface.

The sealing element preferably protrudes outward, in this connection, by way of its outside surface in relation to a top surface of the cap body.

The fact that the sealing element is realized in a convex manner on its outside surface can ensure that no disinfection liquid remains on the sealing element after wiping or dabbing, but can be removed in a reliable, simple manner by means of wiping or dabbing. If the sealing element protrudes outward by way of its outside surface in relation to a top surface of the cap body, the sealing element can easily be accessed by sweeping along the top surface using a suitable disinfection tool, for example a swab or a wipe, in order to dab or wipe the sealing element on its outside surface in this way.

The outside surface of the sealing element corresponds to the side of the sealing element which is visible from the outside and against which a conveying device, for example an injection syringe or an infusion set or also a different conveying device, is able to be positioned. The outside surface is consequently accessible from the outside in order to connect a conveying device to the sealing cap. In one embodiment, the sealing element has a central thickness of between 2 mm and 8 mm and/or an overall diameter of between 4 mm and 14 mm.

The outside surface is advantageously a component part of a sealing head of the sealing element which extends right through the opening. The sealing element is inserted by way of its sealing head in the opening and closes the opening in this way, the outside surface realized on the sealing head pointing outward and consequently being remote from the interior of the sealing cap. In one embodiment, the sealing head has a diameter of between 2 mm and 10 mm. For providing the convex outside surface, the central region of the sealing head preferably has a thickness which is greater by between 0.1 and 1 mm than the edge region of the sealing head. A center of the convex outside surface of the sealing element is preferably situated between 0.1 and 1 mm, preferably between 0.3 mm and 0.7 mm, above an outer upper edge of a sealing head of the sealing element. Accessibility to the outside surface of the sealing element is improved as a result.

In an initial state, a break-off part is preferably connected to the cap body in such a manner that the sealing element is completely covered toward the outside. The break-off part, in this connection, surrounds the outside surface of the sealing element and consequently closes off the outside surface toward the outside such that no dirt in the form of solid or liquid contamination can pass to the outside surface.

In the initial state, the break-off part is advantageously connected integrally, that is to say in one piece, to the sealing cap. The sealing cap, in this connection, can be produced, for example, together with the break-off part as a plastics material molded part, for example by means of plastics material injection molding. The break-off part is connected to the cap body by means of a predetermined breaking point in such a manner that the break-off part can be separated from, in particular broken off from, the cap body along the predetermined breaking point in order to remove the break-off part from the cap body.

The predetermined breaking point extends in an advantageous manner around the opening such that the break-off part is connected to the cap body along a connecting line which extends around the opening and can be separated from the cap body along said connecting line in order to expose the sealing element and to be able to position a conveying device against the outside surface of the sealing element.

In one embodiment, an interior or space between the break-off part and the outside surface of the sealing element is provided in a sterile manner. Consequently, the outside surface of the sealing element is already sterile in the state in which the break-off part is still connected to the sealing cap. Disinfecting the outside surface of the sealing element once the break-off part has been removed and prior to a conveying device being placed in position, in particular by means of wiping or dabbing, is no longer necessary in this case. If, however, legal requirements, for example, make such disinfecting necessary, said additional disinfecting is able to be carried out in a simpler manner, in particular as a result of the convex outside surface of the sealing element.

In a specific design, the sealing cap can comprise, for example, a first connecting device for removing a medical liquid and a second connecting device for supplying a medical liquid. Consequently, two connecting devices are provided at the sealing cap, one of which is designed in particular for removing a medical liquid and the other of which is designed in particular for supplying a medical liquid.

The connecting devices can be realized differently in this connection in order to make it possible to connect different conveying devices, for example an injection syringe or an infusion set. However, it is also conceivable and possible to design the connecting devices in a structurally identical manner and in particular to use identical sealing elements on the connecting devices.

In a first variant, each connecting device can comprise a sealing element, the sealing elements of the connecting devices being realized in an identical manner. Consequently, identical sealing elements are used on the connecting devices, it being possible to provide identical holding devices on the connecting devices, for example in the form of recesses provided on the sealing cap, to hold the sealing elements. This simplifies the design of the sealing cap overall because identical parts can be used to produce the connecting devices.

For example, each sealing element in said variant can comprise a sealing head, which realizes the outside surface, and a sealing body which connects to the sealing head. The sealing body can be connected to a ring collar by means of an extensively circumferential flange, a clamping connection with the sealing cap being produced by means of said ring collar. For example, the ring collar can be inserted in an assigned recess of the sealing cap and held there in a clamping manner such that the sealing element is connected to the sealing cap by means of the ring collar. The sealing element is preferably held in a clamping manner by means of a beaded rim.

For connecting a conveying device, an injection cannula or a mandrel of the conveying device can be positioned against the outside surface of the sealing element in order to pierce the sealing element. In this connection, the sealing element is urged aside, the ring collar remaining on the assigned holding device of the sealing cap and consequently the sealing element being held in position on the sealing cap. If the conveying device is removed again from the sealing cap, the sealing element closes automatically such that the opening of the sealing cap is sealed once again against a passage of liquid, in particular against liquid running out of the container. The sealing element, in a preferred embodiment, is a reclosable sealing element. Where applicable, the sealing element, in particular the sealing element for the connection of a mandrel, can be slotted in portions or continuously.

In a second variant, the sealing elements of the connecting devices can also be realized differently. One sealing element can be realized, in this connection, in particular, for positioning an injection syringe, whilst the other sealing element is realized, in particular, for positioning a mandrel of an infusion set or the like. The sealing elements can consequently be adapted in a particular manner, for example with regard to the thickness thereof which is to be pierced in order to make it possible for an injection syringe or an infusion set or the like to be connected in a favorable manner.

The sealing element of the first connecting device, which serves, for example, for removing a medical liquid by means of an infusion set, can be designed, in this connection, as described above for the first variant and comprise, in particular, a sealing head, which realizes the outside surface, and a sealing body which connects to the sealing head. The sealing body is connected to a ring collar by means of an extensively circumferential flange and is held on a first holding device of the cap body by means of the ring collar. Consequently, a connection between the sealing element and the cap body is produced by means of the ring collar such that the sealing element is held in position on the opening of the cap body by means of the ring collar. The sealing body is to be pierced, for example, by a mandrel of a conveying device, the sealing body being urged aside when the mandrel is positioned and pierced, the sealing element being held overall, however, in position on the cap body of the sealing cap by means of the ring collar.

The sealing element of the second connecting device, in contrast, can comprise a sealing head, which realizes the outside surface, and a sealing body which connects to the sealing head. The sealing body, in this connection, is not fixed on a holding device of the cap body by means of a circumferential ring collar which is attached by means of a flange, but is held on a second holding device of the cap body directly by means of an edge portion. In this way, said second sealing element can be designed in particular for piercing by means of an injection cannula. Because such an injection cannula comprises a comparatively small cross section, there is a smaller amount of deformation on the sealing element compared to the piercing of a mandrel, for example, of an infusion set.

The sealing elements of the various connecting devices, in the case of said variant, can vary in particular in their thickness in order to adapt the connecting devices to the various conveying devices. The second sealing element, which can serve for positioning an injection cannula of an injection syringe, can comprise in particular a greater thickness than the first sealing element which is adapted, for example, for positioning a mandrel of an infusion set. The first sealing element preferably has a central thickness of between 2 mm and 8 mm and in a preferred manner of between 3 mm and 6 mm. The second sealing element preferably has a central thickness of between 2 mm and 8 mm and in a preferred manner of between 3 mm and 7 mm.

The sealing elements can comprise an at least approximately rotationally symmetrical form. For example, the sealing head and the sealing body can be realized in each case in an at least approximately cylindrical manner, the outside surface of the sealing head, which points outward, being realized in a convex manner.

In one embodiment, the bottom surface of the first and/or of the second sealing element, which provides the inside surface, is substantially flat. In the first sealing element, the top surface of the ring collar is lower than the top surface of the sealing head and/or the bottom surface of the ring collar is lower than the bottom surface of the sealing body.

The first sealing element preferably has an overall diameter of between 8 mm and 14 mm and in a preferred manner of between 10 mm and 12 mm. The second sealing element preferably has an overall diameter of between 4 mm and 11 mm and in a preferred manner of between 6 mm and 9 mm. In one embodiment, the sealing head of the first sealing element has a diameter of between 4 mm and 10 mm and in a preferred manner of between 6 mm and 8 mm and/or the sealing head of the second sealing element has a diameter of between 2 mm and 8 mm and in a preferred manner of between 3 mm and 6 mm.

Also within the scope of the invention is a sealing element as such, in particular for the above-described sealing cap according to the invention. The sealing element is characterized in that it is realized in a convex manner at least in portions on an outside surface which is remote from an interior of a container. The sealing element is curved or arcuate, for example, on its outside surface. The sealing element is a sealing element for connecting to a mandrel and/or a cannula. A center of the convex outside surface of the sealing element is preferably between 0.1 and 1 mm, preferably between 0.3 mm and 0.7 mm, above an outer upper edge of a sealing head of the sealing element.

Furthermore, within the scope of the invention is also a bottle which includes an afore-described sealing cap according to the invention. The bottle can be produced, for example, by means of SBM (stretch blow molding) or BFS (blow fill sealing). The bottle and the sealing cap can be connected together in particular by means of clamping, bonding and/or welding. The bottle is preferably filled with an infusion solution.

The concept underlying the invention is to be explained in more detail below by way of the exemplary embodiments shown in the figures, in which.

FIGS. 1A-1C to FIGS. 5A-5D show a first exemplary embodiment of a sealing cap 2 which can be positioned against a container 1, in particular in the form of a bottle, for example a plastics material bottle or a glass bottle, in order to close the container 1 to the outside and to provide access for filling or removing a medical liquid.

The sealing cap 2 is positioned against a container body 10 of the container 1 and is connected to the container body 10 in a sealing manner, for example welded or bonded.

Figure 3A:
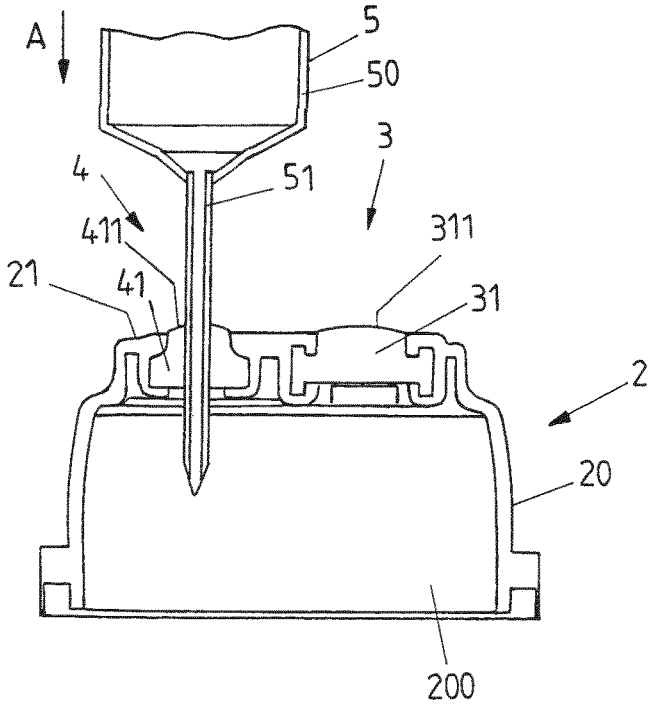
FIG. 3A shows the view according to FIG. 2C, with a conveying device in the form of an injection syringe positioned against a sealing element.
Figure 3B:
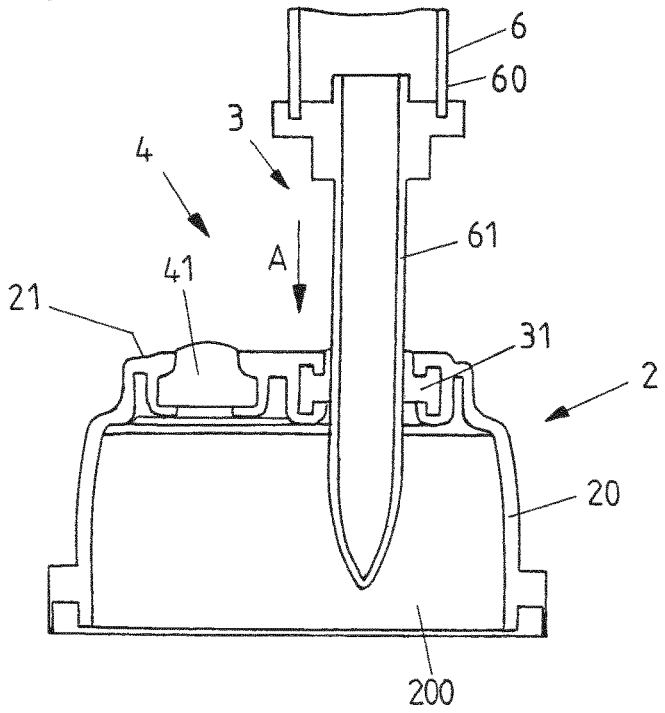
FIG. 3B shows the view according to FIG. 2C, with a conveying device in the form of an infusion set positioned against another sealing element.
Figure 4A:
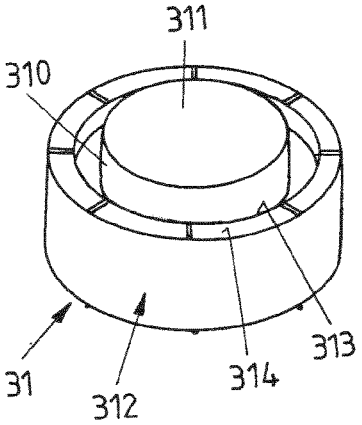
FIG. 4A shows a perspective view of a first sealing element.
Figure 4B:
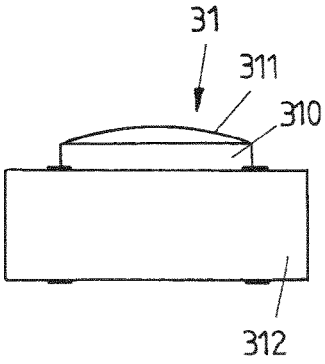
FIG. 4B shows a side view of the sealing element.
Figure 4C:
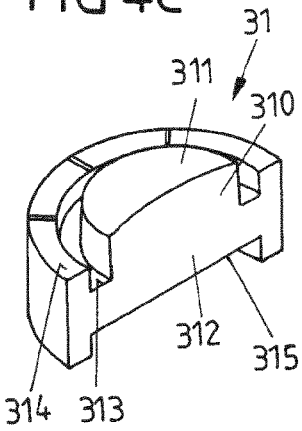
FIG. 4C shows a part sectioned view of the sealing element.
Figure 4D:
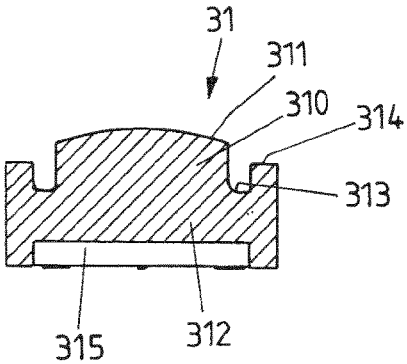
FIG. 4D shows a sectioned view through the sealing element.
Figure 5A:
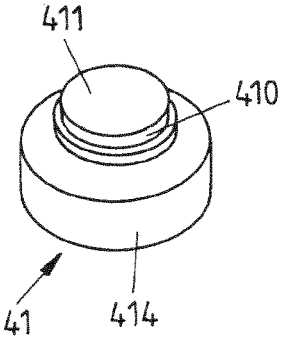
FIG. 5A shows a perspective view of a second sealing element.
Figure 5B:
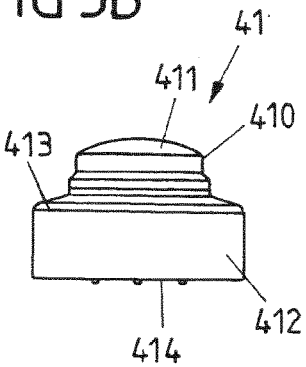
FIG. 5B shows a side view of the sealing element.
Figure 5C:
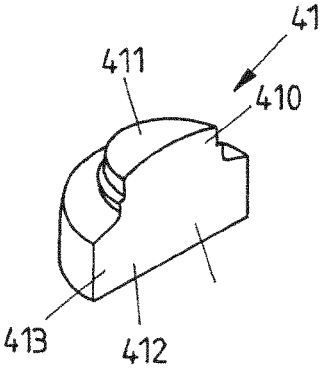
FIG. 5C shows a part sectioned view of the sealing element.
Figure 5D:
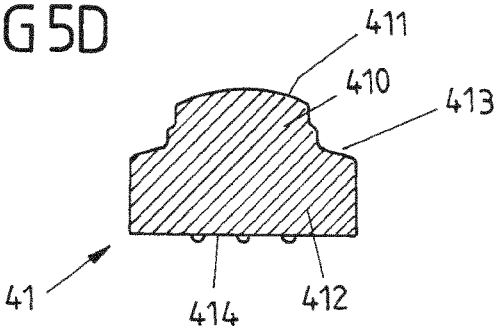
FIG. 5D shows a sectioned view through the sealing element.
Figure 6A:
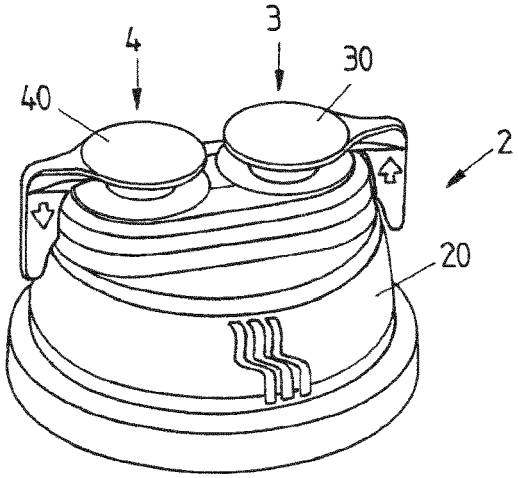
FIG. 6A shows a perspective view of a second exemplary embodiment of a sealing cap.
Figure 6B:
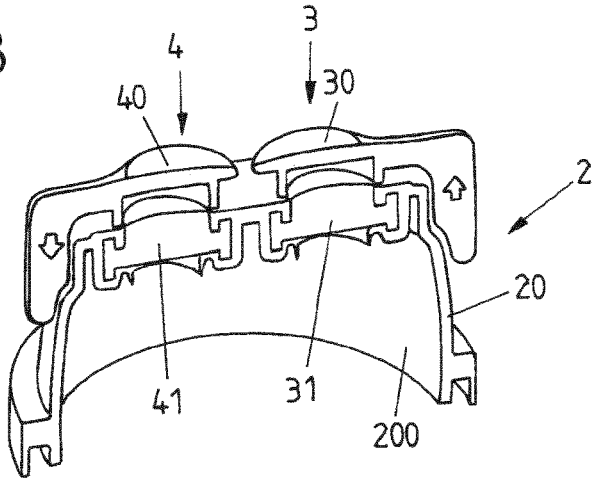
FIG. 6B shows a part sectioned view of the sealing cap according to FIG. 6A.
Figure 6C:
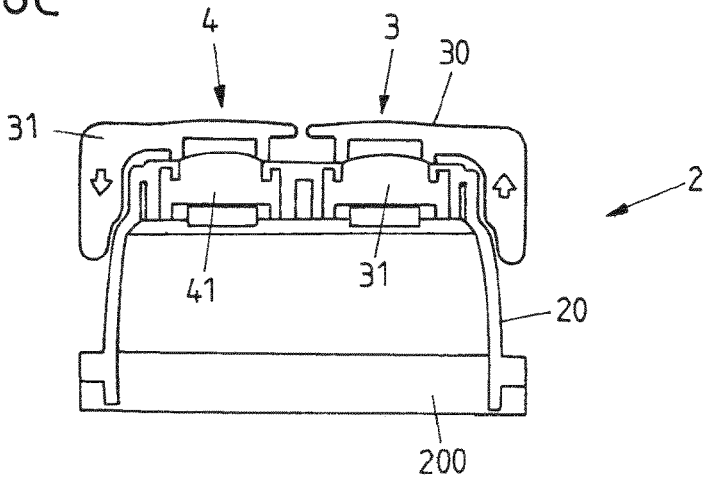
FIG. 6C shows a side view of the arrangement according to FIG. 6B.
Figure 7A:
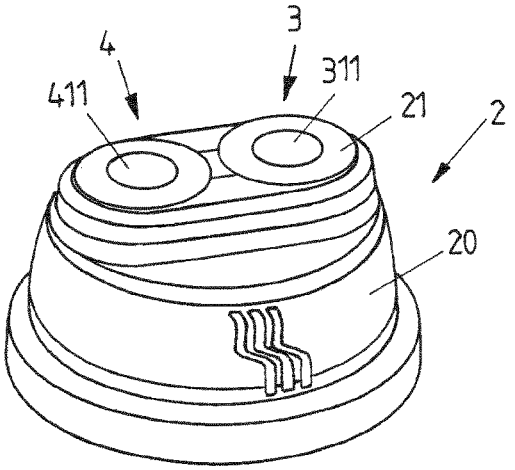
FIG. 7A shows a perspective view of the sealing cap according to FIG. 6A, with break-off parts removed.
Figure 7B:
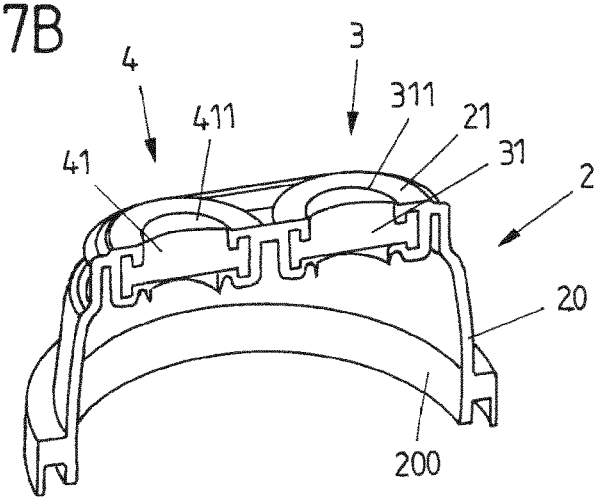
FIG. 7B shows a part sectioned view of the arrangement according to FIG. 7A.
Figure 7C:
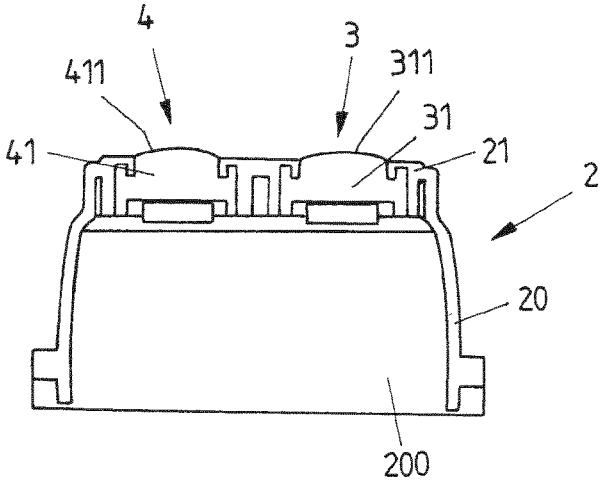
FIG. 7C shows a side view of the arrangement according to FIG. 7B.

The sealing cap 2 comprises a cap body 20 which, on a top surface 21, comprises two connecting devices 3, 4 for connecting various conveying devices 5, 6 (see FIGS. 3A and 3B). The connecting devices 3, 4 each comprise a sealing element 31, 41 which is received in a holding device 32, 42 in the form of a positive locking holder on the cap body 20 and is held in a clamping manner on the holding device 32, 42. The holding devices 32 and 42 are each realized, in particular, as a, preferably ring-shaped, beaded rim. The sealing elements 31, 41 serve for the purpose of closing openings 321, 421 on the top surface 21 of the cap body 20 to the outside, in each case, for this purpose, a sealing head 310, 410 of the sealing element 31, 41 projecting into the assigned opening 321, 421 and closing it in a sealing manner. The sealing elements 31, 41 are inserted into the openings 321, 421 with the holding devices 32 and 42 not initially being bent round. The holding devices 32 and 42 are then bent round as shown, for example, in FIG. 1C to fix the sealing elements 31 and 42.

Figure 1A:
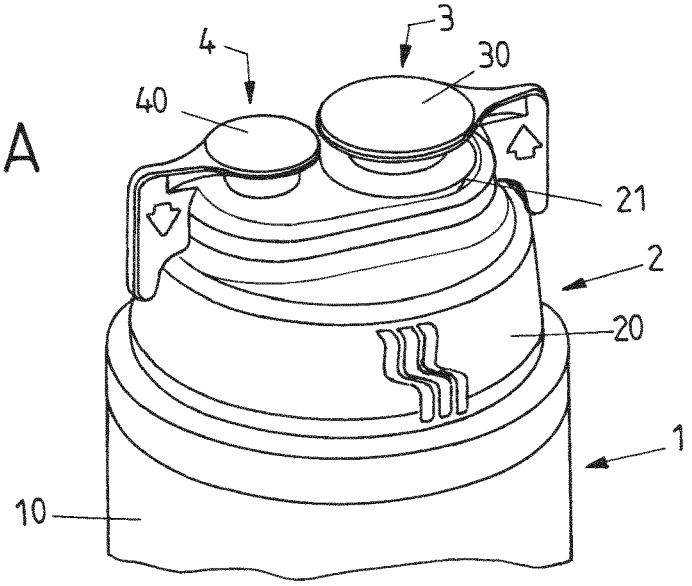
FIG. 1A shows a perspective view of a sealing cap on a—schematically shown—container.
Figure 1B:
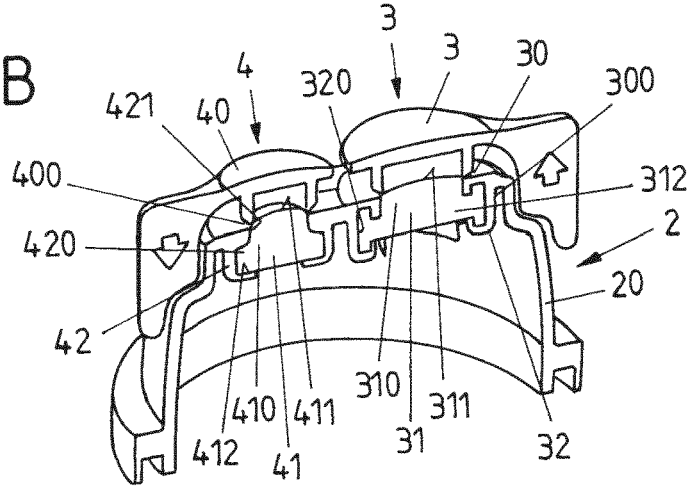
FIG. 1B shows a part sectioned view of the sealing cap according to FIG. 1A.
Figure 1C:
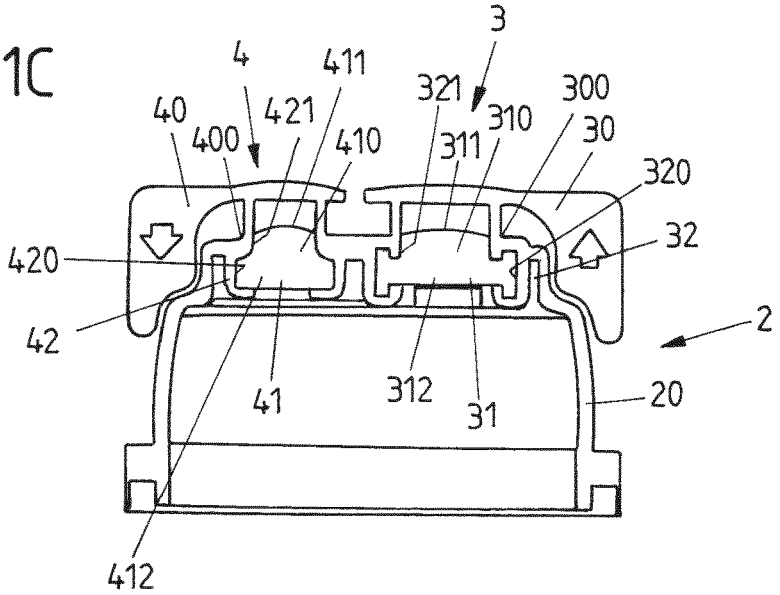
FIG. 1C shows a side view of the arrangement according to FIG. 1B.

The connecting devices 3, 4 are each covered by a break-off part 30, 40 in an initial state, shown in FIGS. 1A-1C, and are closed to the outside in such a manner that the openings 321, 421 with the sealing elements 31, 41 arranged therein are not accessible from the outside and are protected against contamination. The interior formed by the break-off part 30, 40 is preferably sterile.

A first connecting device 3 serves for removing a medical liquid out of the container 1. A different, second connecting device 4 serves, in contrast, for supplying a medical liquid into the container 1. A medical liquid is removed, as shown in FIG. 3B, by means of a conveying device 6 in the form of a removal device, which is realized, for example, by an infusion set, comprises a mandrel 61 with a comparatively large cross section and can be positioned against the sealing element 31 of the assigned connecting device 3 by way of the mandrel 61. A medical liquid is supplied, in contrast, by means of a conveying device 5 in the form of an injection syringe, which is shown in FIG. 3A and can be positioned by way of an injection cannula 51 against the sealing element 41 of the assigned, second connecting device 4 in order to pierce the sealing element 41.

Because the mandrel 61 of the removal device 6 comprises a comparatively large cross section, the assigned opening 321 of the connecting device 3 is also comparatively large, and the sealing element 31, which is rotationally symmetrical in its basic form, correspondingly comprises a sealing head 310 with a comparatively large diameter. The sealing head 310 of the first sealing element 31 preferably has a diameter in a preferred manner of between 5 mm and 9 mm and/or the sealing head 410 of the second sealing element 41 has a diameter of between 3 mm and 6 mm.

In contrast, the opening 421 of the other, second connecting device 4 is smaller, and the sealing head 410 of the second sealing element 41, which extends into the opening, correspondingly comprises a comparatively small diameter.

Detailed, separate images of the sealing elements 31, 41 are shown in FIGS. 4A-4D and FIGS. 5A-5D.

The first sealing element 31 comprises a sealing head 310 with an outwardly pointing, convex outside surface 311. A sealing body 312, which is connected by means of a circumferential flange 313 to an equally extensively circumferential ring collar 314, connects to the sealing head 310—at the back of the outside surface 311. The sealing element 31 is inserted in an opening 320 of the holding device 32 by means of the ring collar 314 and is held in a clamping manner on the holding device 32 in this manner. A bottom surface 315 of the sealing element 31 points into an interior 20 of the sealing cap 2 (see, for example, FIG. 3A). The bottom surface 31 of the first sealing element 31 is substantially flat here. In the first sealing element 31, the top surface of the ring collar 314 is lower than the outside or top surface 311 of the sealing head 310. In addition, the bottom surface of the ring collar 314 is lower than the inside or bottom surface 315 of the first sealing body 31. The ring collar 314 consequently extends beyond the bottom surface 315.

The other, second sealing element 41 also comprises a rotationally symmetrical form and consists of a sealing head 410, to which at the back of a convexly curved outside surface 411 a cylindrical sealing body 412 connects. The sealing element 41 is fixed directly in an opening 420 of the assigned, second holding device 42 by means of said cylindrical sealing body 412 by an edge portion 413 of the sealing element 41 being held in a clamping manner in the opening 420 of the holding device 42. A bottom surface 414 of the sealing element 41 points toward the interior 200 of the sealing cap 2. The bottom surface 414 of the second sealing element 41 is substantially flat here.

The maximum thickness—when viewed along a positioning direction A in which a conveying device 5, 6 is to be positioned against a respectively assigned sealing element 31, 41 (see FIGS. 3A and 3B)—of the first sealing element 31, measured between the outside surface 311 and the inside surface 315, is smaller than the maximum thickness of the other, second sealing element 41, measured once again between the outside surface 411 and the inside surface 414. The different design in diameter and thickness is brought about as result of the assigned first sealing element 31 having to be urged aside to a considerably greater extent, when a mandrel 61 is positioned, as shown in FIG. 3B, than when an injection cannula 51 is positioned against the assigned second sealing element 41. The first sealing element 31 is consequently able to be pierced and urged in a favorable manner when a mandrel is placed in position.

The same applies to the second sealing element 41 when an injection cannula 51 is placed in position.

Both sealing elements 31, 41 are closed again automatically when the respectively assigned conveying device 5, 6 is removed again from the connecting device 3, 4.

Because the sealing elements 31, 41 are curved in a convex manner on their outside surfaces 311, 411 and additionally protrude outward beyond the top surface 21 of the cap body 20, the sealing elements 31, 41 can be dabbed or wiped in a favorable manner for the purposes of disinfection, as can be proscribed, where applicable, by legal requirements. In particular, the design of the sealing elements 31, 41 on their outside surfaces 311, 411 ensures that the outside surfaces 311, 411 can be reached by a suitable disinfection tool, for example a swab or a wipe, the convex curvature additionally ensuring that disinfecting liquid or other residue does not remain on the outside surface 311, 411 after dabbing or wiping, but rather that the sealing element 31, 41 is able to be wiped in a favorable manner. The central region of the sealing head 310 preferably has a thickness which is thicker than the edge region of the sealing head 310 by between 0.1 mm and 1 mm. The center of the convex region (see FIGS. 4B and 5B in this regard) is between 0.1 and 1 mm and in a preferred manner between 0.3 mm and 0.7 mm above the outer edge.

The procedure for positioning a conveying device 5, 6 against an assigned connecting device 3, 4 is basically as follows.

In an initial state, the sealing cap 2, which is connected to the container 1, is present with the break-off parts 30, 40 arranged fixedly thereon. The break-off parts 30, 40 are realized integrally with the cap body 20 and are connected to the cap body 20 by means of circumferential predetermined breaking points 300, 400 in such a manner that the outside surfaces 311, 411 of the sealing elements 31, 41 are covered toward the outside.

Figure 2A:
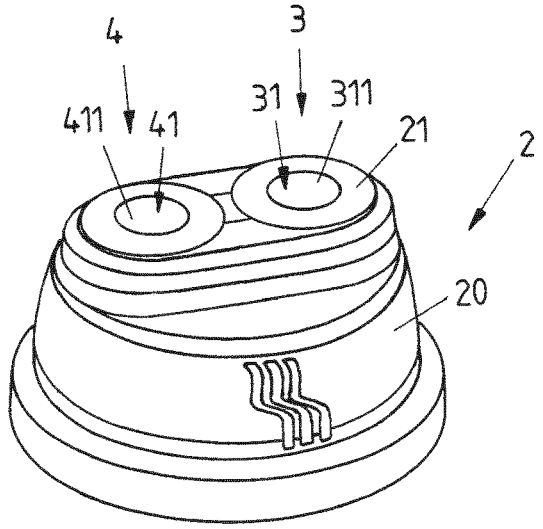
FIG. 2A shows a perspective view of the sealing cap, with break-off parts removed.
Figure 2B:
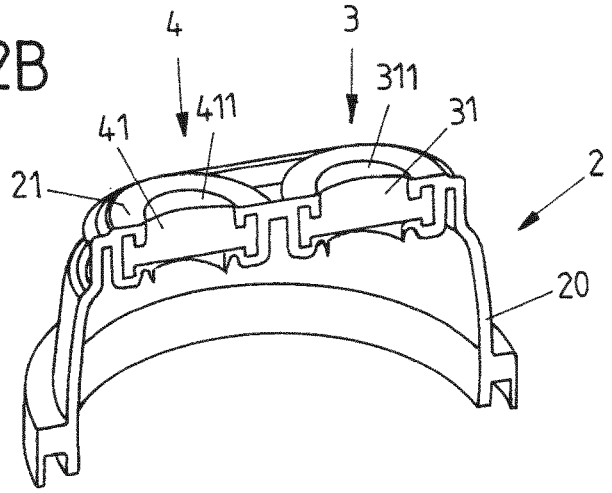
FIG. 2B shows a part sectioned view of the sealing cap according to FIG. 2A.
Figure 2C:
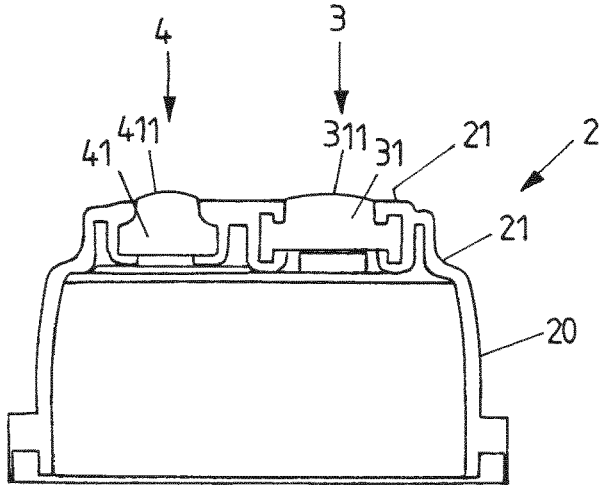
FIG. 2C shows a side view of the arrangement according to FIG. 2B.

If a conveying device 5, 6 is to be positioned against an assigned connecting device 3, 4, the respective break-off part 30, 40 is removed from the cap body 20 by a user gripping the break-off part 30, 40 between his fingers and breaking it off the cap body 20 along the predetermined breaking point 300, 400. The respective sealing element 31, 41 is exposed in this way such that the conveying device 5, 6 can be positioned against the outside surface 311, 411 of the sealing element 31, 41 (see FIGS. 2A to 2C).

By means of a suitable piercing tool, the sealing element 31, 41 is then pierced such that a flow connection between a body 50, 60 of the respective conveying device 5, 6 and the interior of the container 1 is created such that a medical liquid can be filled into the container 1 or removed out of the container 1.

The sealing cap 2 can be produced with its cap body 20 preferably from plastics material, for example by means of plastics material injection molding. In this connection, the break-off parts 30, 40 of the connecting devices 3, 4 are initially molded in one part with the cap body and can be broken off the cap body 20 to access one of the sealing elements 31, 41.

Whilst the cap body 20 is produced from a comparatively rigid plastics material, the sealing elements 31, 41 are produced from a comparatively soft, elastic material, for example polyisoprene or a thermoplastic elastomer.

In the case of an exemplary embodiment of a sealing cap 2 shown in FIGS. 6A-6C and 7A-7C, the connecting devices 3, comprise identical sealing elements 31, 41 which are arranged in a clamping manner in holding devices 32, 42 which are structurally identical to one another. The form of the sealing elements 31, 41, in this connection, corresponds to the realization shown in FIGS. 4A-4D.

Once again, one connecting device 3 serves for removing a medical liquid out of a container 1 which is connected to the sealing cap 2, whilst the other connecting device 4 serves for filling a medical liquid. One conveying device 5 in the form of an injection syringe with an injection cannula or a conveying device with a mandrel can be used, in this connection, both for removing and for filling.

The exemplary embodiment according to FIGS. 6A-6C and FIGS. 7A-7C is otherwise identical to the previously described exemplary embodiment such that reference is to be made to the above statements.

The concept underlying the invention is not restricted to the exemplary embodiments depicted above, but can also be realized, in principle, in completely different embodiments.

As a result of the outwardly pointing outside surface of the sealing elements being realized in a convex manner and preferably protruding outwardly beyond a front surface of the cap body of the sealing cap (when the break-off parts of the connecting devices have been removed), the sealing elements are able to be wiped or dabbed on their outside surfaces in an easy, effective manner for the purposes of disinfection.

In principle, a sealing cap can also comprise only one connecting device with one sealing element or more than two connecting devices each with one sealing element.

It is equally conceivable, in principle, for only one sealing element of several sealing elements of several connecting devices to be realized in a convexly curved manner on its outside surface.

LIST OF REFERENCES

1 Container
10 Container body
2 Sealing cap
20 Cap body
200 Interior
21 Top surface
3 Connecting device
30 Break-off part
300 Predetermined breaking point
31 Sealing element
310 Sealing head
311 Outside surface
312 Sealing body
313 Flange
314 Ring collar
315 Inside surface
32 Holding device
320 Opening
321 Opening
4 Connecting device
40 Break-off part
400 Predetermined breaking point
41 Sealing element
410 Sealing head
411 Outside surface
412 Sealing body
413 Edge portion
414 Inside surface
42 Holding device
420 Opening
421 Opening
5 Injection device
50 Body
51 Injection needle
6 Removal device
60 Body
61 Mandrel
A Positioning direction

The invention claimed is:

1. A sealing cap for a container for holding a medical liquid, the sealing cap comprising a cap body and a connecting device that is arranged on the cap body, wherein the connecting device comprises a sealing element arranged on the cap body to seal an opening in the cap body, the sealing element comprising an outside surface that faces away from an interior defined by the cap body and being convex on the outside surface thereof, wherein the outside surface of the sealing element protrudes outward in relation to a top surface off the cap body, a break-off part that, in an initial state, is fixedly connected to the cap body and covers the outside surface of the sealing element, and a pre-determined breaking point that connects the break-off part to the cap body such that the break-off part detaches from the cap body along the predetermined breaking point, wherein the connecting device is connectable to a conveying device that is able to be positioned against the outside surface while conveying medical liquid into the container or drawing medical liquid from the container.

2. The sealing cap as claimed in claim 1, wherein an interior between the break-off part and the outside surface of the sealing element is sterile.

3. The sealing cap as claimed in claim 1, wherein a sealing head of the sealing element extends through the opening and forms the outside surface.

4. The sealing cap as claimed in claim 1, wherein a center of the convex outside surface of the sealing element is above an outer upper edge of a sealing head of the sealing element, wherein the distance between the center and the outer upper edge is between 0.3 millimeters and 0.7 millimeters.

5. The sealing cap as claimed in claim 1, wherein the predetermined breaking point extends around the opening.

6. The sealing cap as claimed in claim 1, wherein the connecting device is a first connecting device for removing a medical liquid and wherein the sealing cap further comprises a second connecting device for supplying a medical liquid.

7. The sealing cap as claimed in claim 6, wherein each connecting device comprises a sealing element and wherein the sealing elements of the connecting devices are identical in structure.

8. The sealing cap as claimed in claim 7, wherein each sealing element comprises a sealing head, which forms the outside surface, and a sealing body which connects to the sealing head, wherein a ring collar that holds the sealing body on a holding device extends around the positioning direction and wherein a flange connects the ring collar to the sealing body.

9. The sealing cap as claimed in claim 6, wherein each connecting device comprises a sealing element and wherein the sealing elements of the connecting devices differ from each other in structure.

10. The sealing cap as claimed in claim 9, wherein the sealing element of the first connecting device comprises a sealing head, which realizes the outside surface, and a sealing body, which connects to the sealing head, wherein a ring collar that extends around the positioning direction holds the sealing body on a first holding device of the cap body, and wherein a flange connects the ring collar to the sealing body.

11. The sealing cap as claimed in claim 9, wherein the sealing element of the second connecting device comprises a sealing head, which forms the outside surface, and a sealing body, which connects to the sealing head and wherein and edge portion, which extends around the positioning direction, holds the sealing body on a second holding device of the cap body.

12. The sealing cap as claimed in one of claim 9, wherein the sealing elements, when viewed along the positioning direction, comprise a different thickness which is to be pierced by the conveying device.

13. The sealing cap of claim 1, wherein the sealing element comprises a sealing head having an outer edge and a convex portion on an outside surface that is remote from an interior of the container and wherein a center of the convex outside surface is between 0.3 millimeters and 0.7 millimeters above the outer edge.

14. The sealing cap of claim 1, wherein the sealing element comprises a sealing head having an outer edge and a convex portion on an outside surface that is remote from an interior of the container and wherein a center of the convex outside surface is between 0.3 millimeters and 0.7 millimeters above the outer edge.

15. A manufacture comprising: a bottle including a sealing cap as recited in claim 1.

16. The manufacture of claim 15, wherein the bottle is filled with an infusion solution.

* * * * *